United States Patent [19]

Hilge et al.

[11] Patent Number: 4,620,840

[45] Date of Patent: Nov. 4, 1986

[54] FURNACE FOR HEATING UP CYLINDRICAL CHARGES

[75] Inventors: Bernhard Hilge, Mettmenstetten, Switzerland; Carl Kramer; Martin Knoch, both of Aachen, Fed. Rep. of Germany

[73] Assignee: Swiss Aluminium Ltd., Chippis, Switzerland

[21] Appl. No.: 735,391

[22] Filed: May 17, 1985

[30] Foreign Application Priority Data

May 18, 1984 [DE] Fed. Rep. of Germany ..... 3418603

[51] Int. Cl.[4] ..... F27B 9/14; F27D 3/00

[52] U.S. Cl. ..... 432/121; 432/124; 432/145

[58] Field of Search ..... 432/121, 124, 133, 152, 432/144, 145

[56] References Cited

U.S. PATENT DOCUMENTS

| | | | |
|---|---|---|---|
| 1,834,304 | 12/1931 | Frank et al. | 432/124 |
| 1,872,713 | 8/1932 | Fahrenwald | 432/124 |
| 2,697,860 | 12/1954 | Anthony | 432/124 |
| 3,813,212 | 5/1974 | Shofner et al. | 432/124 |
| 3,994,678 | 11/1976 | Nelson | 432/145 |
| 4,065,249 | 12/1977 | Nelson | 432/145 |
| 4,184,839 | 1/1980 | Landgraf et al. | 432/124 |
| 4,481,398 | 11/1984 | Lavins et al. | 432/121 |

*Primary Examiner*—Henry C. Yuen

*Attorney, Agent, or Firm*—Bachman & LaPointe

[57] ABSTRACT

A furnace for heating cylindrical charges, in particular billets, rods and tubes, features a transportation facility with a conveyance device which feeds the charges in the longitudinal direction through a treatment chamber, the cross-sectional shape of which is closely similar to that of the charge; the transportation device also features a jacking device which supports the charge such that, regardless of the charge diameter, the longitudinal axis of the charge is always at the same level in the treatment chamber. Situated in the walls of the treatment chamber are nozzle outlets which direct a heated jet of gas radially with respect to the longitudinal axis of the charge and onto the surface of the charge. The feeding of circulating hot gas to the supply channel for the nozzles takes place from both ends of the treatment chamber. A ventilator is situated above the mid point along the length of the treatment chamber and blows out both inlets to the feed channels.

9 Claims, 7 Drawing Figures

FURNACE FOR HEATING UP CYLINDRICAL CHARGES

BACKGROUND OF THE INVENTION

The invention relates to a furnace which is for heating up billets, rods, tubes and similar cylindrical charges.

Known from WO No. 83/02661 is a furnace for heating up billets, rods, tubes and similar cylindrical charges which are passed through a treatment chamber by means of a transportation device. This transportation device is, however, of a specific, pre-determined height such that the longitudinal axis of charges of different diameter do not lie exactly in the middle of the treatment chamber. As a result the surface of the charge is non-uniformly jetted by the hot gas stream, which produces non-uniform heating that can cause distortion e.g. curvature of the charges. This, in turn, adversely affects the further processing of the said charge. The said distortion or curvature produces even more pronounced non-uniform heating as the distance between the wall of the cylindrical treatment chamber and the surface of the item being treated varies in an uncontrolled manner.

The ventilator impellers or fans for producing the circulating gas stream are arranged such that the charge being treated is not uniformly heated by the gas stream along its whole length, unless additional, expensive and pressure-reducing constructive means such as deflectors are provided; this non-unformity in heating is due to the impellers being arranged on one side only. Furthermore, the impellers blow the hot gas perpendicular to the longitudinal axis of the charge being treated with the result that recovered pressure in the impeller housing presents problems.

A further disadvantage of this known heating furnace lies in the use of slit-shaped nozzles for the convective heating. These nozzles, arranged along the length of the charge being treated, create narrow jets of hot gas, the exit velocities of which vary in different directions over the periphery of the charge so that non-uniform impingement and hence non-uniform heating around the periphery results.

Corresponding constructions are revealed in the German patent publications DE-OS No. 2'929'322, DE-OS No. 2'712'279, DE-AS No. 2'637'646 and DE-OS No. 2'349'765.

In the light metal industry, for example in the case of cylindrical charges of aluminum, ever increasing demands are being made with respect to the uniformity of heating and the accuracy of holding at the required temperature. Also, for economic reasons it is desireable that the treatment time should be kept as short as possible; consequently, efforts are made to make the thermal gradient as large as possible. However, under conditions of high thermal gradients, local fluctuations in particular have a very pronounced effect, and can lead to local overheating. This is a serious shortcoming in heating furnaces in which the cylindrical charge is heated directly by flames in order to improve the heat transfer conditions, such as is known from the U.S. Pat. No. 3,837,794.

Also known are heating furnaces in which the charge is rotated during treatment (U.S. Pat. No. 4,410,308) or is inductively heated (German patent publication DE-OS No. 2'628'657). The outlay for the necessary constructions, however, is large in such cases.

Furthermore the inductive heating does not guarantee uniform heating of the cylindrical charge over its whole length.

Revealed in the German patent publication DE-OS No. 2'919'207 is a transportation device for a heating furnace, in which, however, the heating of the cylindrical charge takes place by direct contact with heated, refractory blocks i.e. not via convective heating.

A heating furnace of the kind mentioned at the start is revealed in U.S. Pat. No. 4,065,249, and features a treatment chamber the shape of which takes into account the cross-section of the charge, a transportation device for driving the charge in the direction of its longitudinal axis through the treatment chamber, a ventilator or fan to generate a gas stream, a heating device for heating the gas stream, and nozzle outlets to introduce the heated gas stream into the treatment chamber. Here too, however, the above mentioned disadvantage prevails i.e. the non-uniform heating of the cylindrical charge over its length and/or over its periphery, a shortcoming which is due to the non-uniform impingement of the hot gas stream on the item being treated.

The object of the present inventions is therefore to develop a heating furnace of the kind discussed above, in which the above mentioned disadvantages do not occur.

The proposed furnace should in particular produce a defined, uniform heating-up of the cylindrical charge over its whole length and periphery, and eliminate distortion due to non-uniform heating.

SUMMARY OF THE INVENTION

This object is achieved in accordance with the present invention. The furnace of the present invention, for heating billets, rods, tubes and the like cylindrical charges having a longitudinal axis which comprises at least one treatment chamber having walls, nozzle outlets in said walls which direct jets of heated gas radially with respect to said longitudinal axis and onto the surface of the charge, feed channels communicating with said nozzles for supplying heated gas to the nozzles, said channels having inlets, a transportation device for moving the charge in the direction parallel to its longitudinal axis into the treatment chamber including a conveyance device for the horizontal movement of the charge and a jacking device for centering the charge in the treatment chamber vertical to the longitudinal axis of the charge and as a function of its size in cross-section, a ventilator fan communicating with said chamber for generating a circulating gas stream arranged above the mid point and along the length of said chamber such that it blows out the inlets to said feed channels, and a heating device for heating the gas stream.

Useful versions of the furnace according to the invention are discussed in ensuing specification.

The advantages obtained by way of the invention are due in particular to the impingement of the cylindrical charge by the circulating gas stream in such a manner that, also when the charges are of different diameter, a symmetrical distribution of heat transfer is always obtained over the surface of the charge and over its length. To this end the cylindrical shaped charges are, in each case, held at a constant, defined axis in the furnace; further, the heat transfer is achieved by a series of nozzles the jets from which are directed exactly radially to the longitudinal axis of the cylindrical charge, as a result of which stable, defined heat transfer conditions are ensured. The exact radial setting of the impinging gas streams is in turn achieved by appropriate designing of the hot gas flow path and the ducting for this purpose which features the nozzle outlets.

BRIEF DESCRIPTION OF THE DRAWINGS

The invention is explained in greater detail in the following with the aid of an exemplified embodiement and by reference to the accompanying schematic drawings wherein.

DETAILED DESCRIPTION

Figure 2:
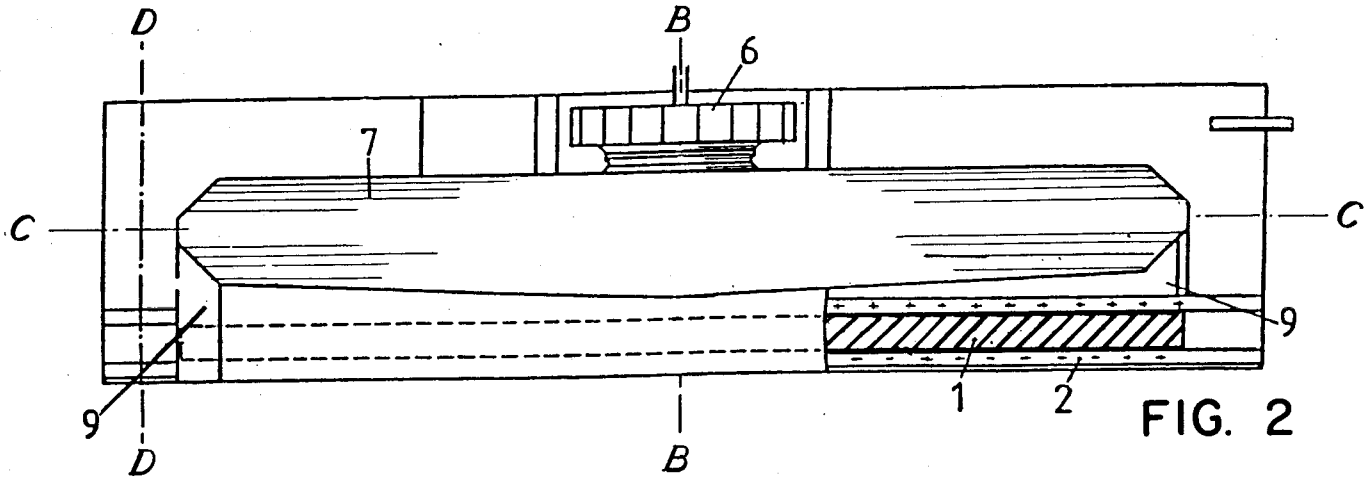
FIG. 2 represents a cross-section along line A—A in FIG. 1.
Figure 1:
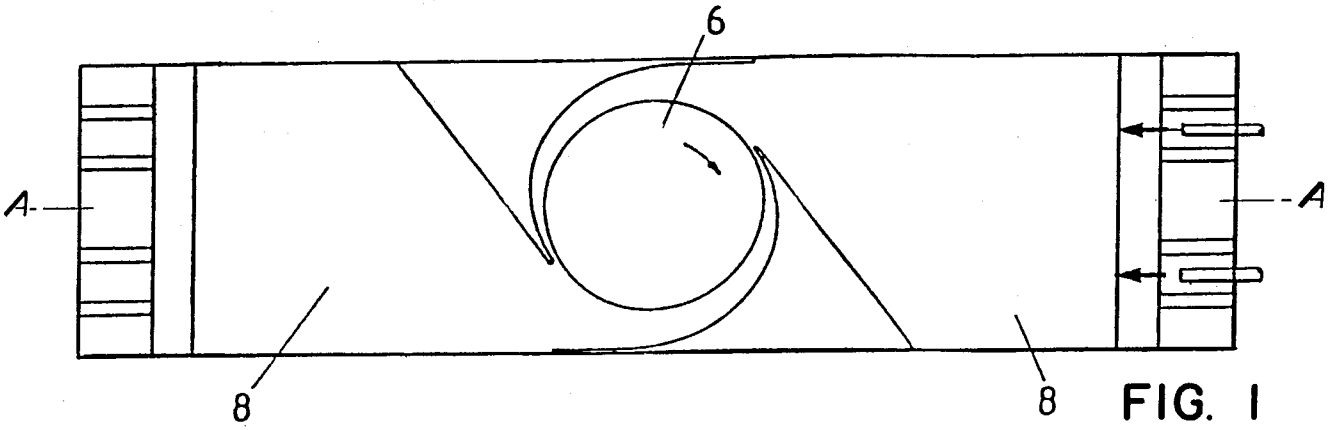
FIG. 1 represents a plan view of a heating furnace.

The charge which is to be heated is indicated schematically in the drawings by a cylindrical billet 1 which is situated in a cylindrical treatment chamber 2. This billet 1 is introduced in the horizontal direction into the treatment chamber by means of the transportation device shown in FIGS. 6 and 7, then raised in the vertical direction by a jacking device, integrated in the transportation device, until centered in the treatment chamber where, as required, it is held for a given period of time before being lowered again and finally conveyed out of the treatment chamber 2. The device for transporting the billet 1 runs horizontally i.e. parallel to the central, longitudinal axis of the billet.

Figure 4:
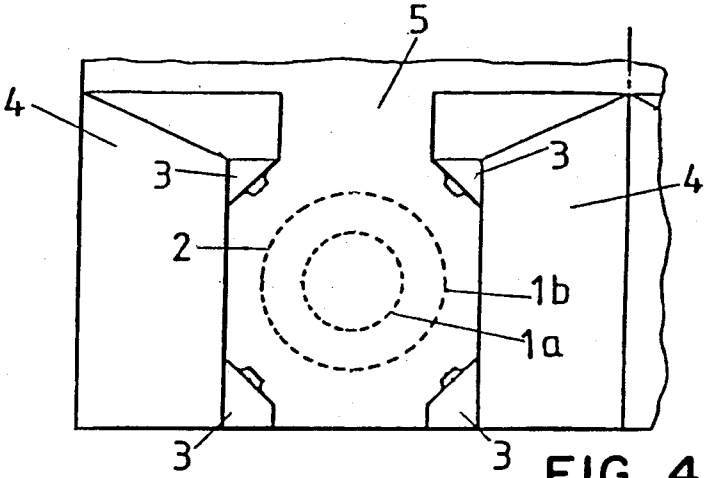
FIG. 4 represents a detail Z from FIG. 5 shown on an enlarged scale and corresponding to the section along line D—D in FIG. 2.
Figure 3:
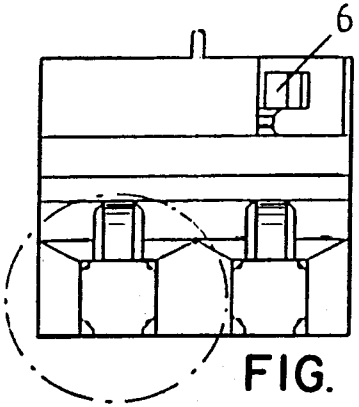
FIG. 3 represents a cross-section along line B—B in FIG. 2.

As can be seen in FIG. 4 the transportation device conveys the billet 1 into the treatment chamber in such a manner that the longitudinal axis of all billets 1, independent of the billet diameter, is held at the same height in the treatment chamber 2. In FIG. 4 the minimum billet diameter is indicated by 1*a* and the maximum billet diameter by 1*b*. It can be seen that in both cases the longitudinal axis of the billets 1*a* and 1*b* are identically situated.

The outer walls of treatment chamber 2 are formed by the sidewalls of channels 4 which supply the treatment gas, for example air, and terminate in nozzle outlets 3 in the walls of the treatment chamber 2. The nozzle outlets are arranged in the walls in such a manner that the jet streams emerging from them are directed exactly radially to the billet 1 in chamber 2. To this end the points of impingement of the jet streams on the mantle of the billet are such that if the surface of the billet were to be "rolled out" to form a flat surface, the said points would lie at the corners of equilateral triangles, the length of the side of the equilateral triangles being about the same as the distance betwen the nozzle outlet face and the surface of a billet of average diameter. In the case of circular nozzle outlets 3 the diameter of the nozzle outlet 3 is about one fifth of the average distance from the surface of the billet 1.

An opening 5 with a ventilator fan 6 situated above it is provided for the removal of the gas striking the billet 1. The treatment gas can therefore be extracted, unhindered, from the billet 1 to a section chamber 7 which extends almost the whole length of the billet.

The ventilator 6 conveys the treatment gas symmetrically on both sides into diffusers 8. At the end of these diffusers 8 i.e. where the diffusers widen to about the width of the unit, burners are provided, the flames from which are directed towards the gas stream flowing from the ventilator 6. As a result the hot gases mix very uniformly with the circulating treatment gas from the ventilator 6. Burners for all common fuels can be employed there. If indirect heating is employed, the steel pipes and the heating grid if electrical heating is used are built into the gas channel at the end of the diffusers. The narrowing of that channel causes the heating gas to be accelerated; this then results in a uniform flow pattern at the entry region 9 of the supply channels 4 for the nozzle outlets 3.

Figure 5:
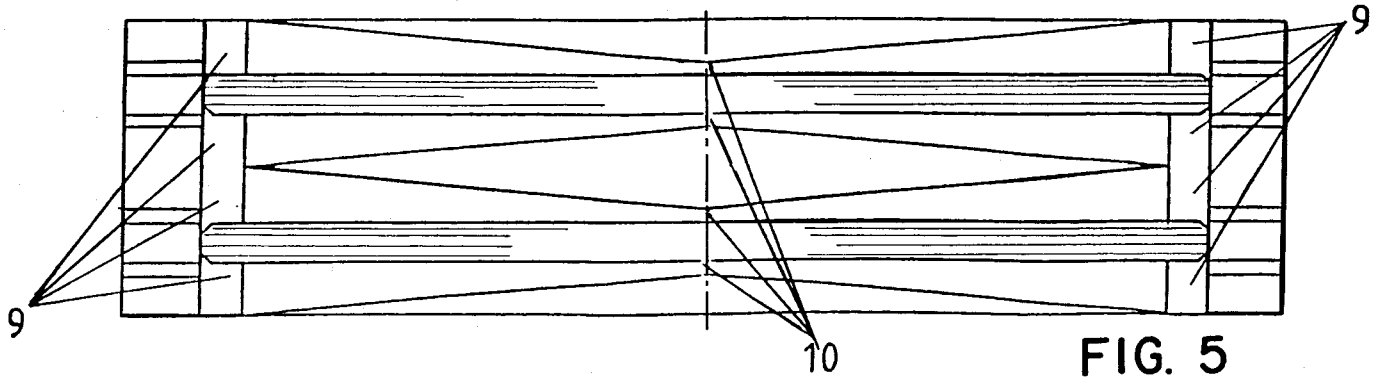
FIG. 5 represents a section along line C—C in FIG. 2.

The channels 4 for feeding heating gas to the nozzle outlets 3 taper down from the entry cross-section 9 to the cross-section 10 at the middle, as shown in FIG. 5; in doing so the same flow angle prevails on the inside of the nozzle outlets 3.

Figure 6:
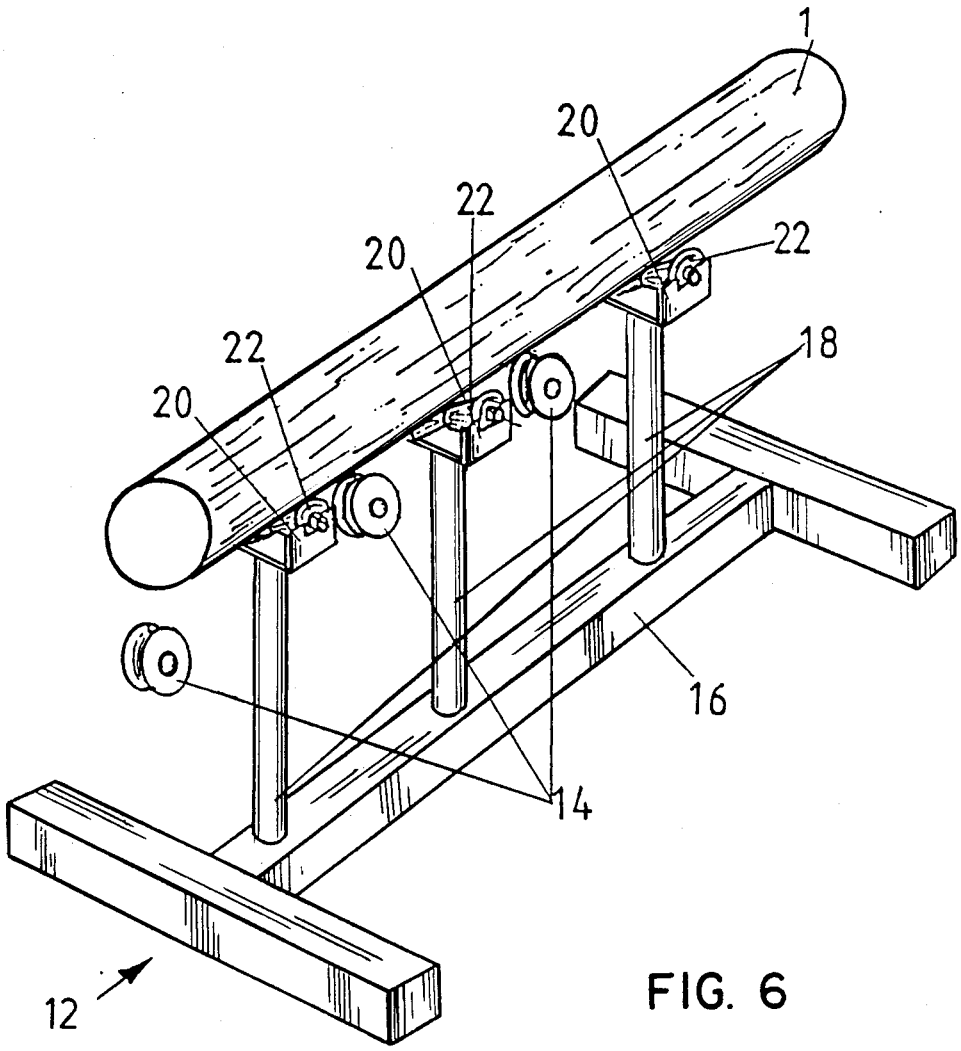
FIG. 6 represents a perspective view of the transportation device.

The device for transporting the charge is described in the following with reference to FIGS. 6 and 7. The transportation device, comprising conveyance and jacking device, is indicated as a whole by numeral 12. The said device features a set of horizontal, stationary transportation rolls 14; the rotatable rolls 14 of this roll set are a fixed vertical height and serve only for the horizontal movement of the billets 1 into and out of the treatment chamber 2.

Integrated in the roll assembly 14 is a jacking device with base frame 16 which can be moved in the vertical direction by jacking facilities that are not shown here e.g. screw jacks or hydraulic pistons. The frame 16 bears a plurality of vertical jacking rods 18 (three such rods are shown in FIG. 6) which feature horizontal bearing yokes 20 at their uppermost ends. The bearing surfaces of the yokes 20 are of a suitable material, for example a ceramic or sintered material, for the shafts of the double V-shaped rolls 22.

Figure 7:
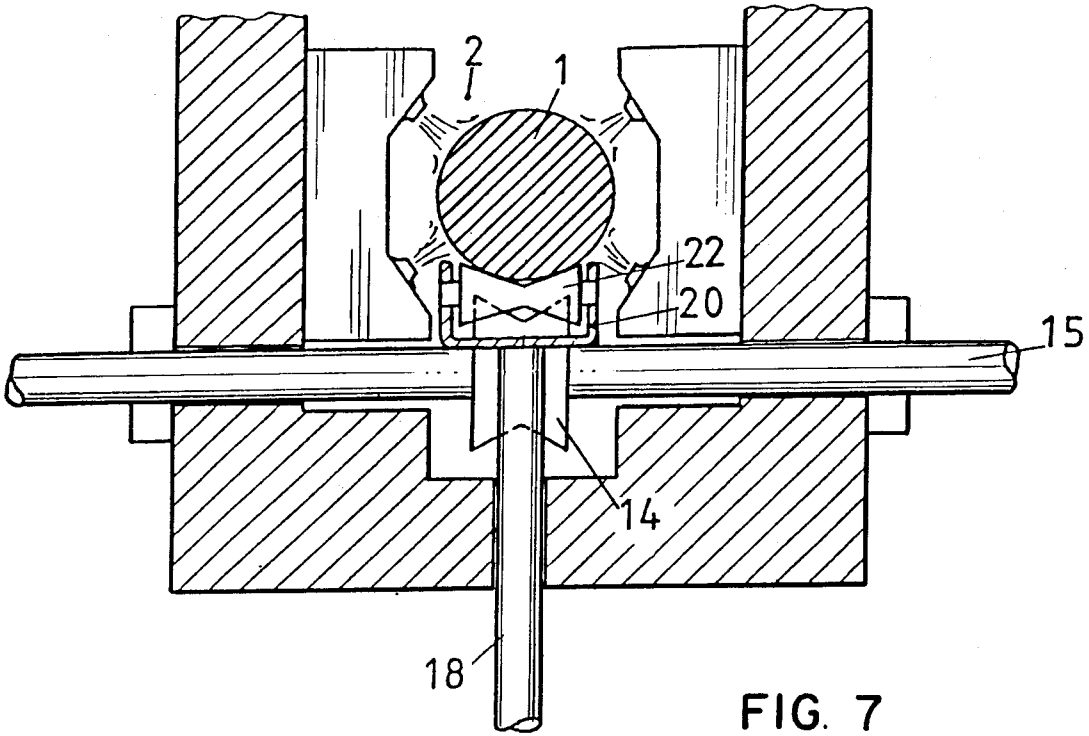
FIG. 7 represents a vertical section through the transportation device.

As shown in FIG. 7 the shafts 15 of the rolls 14 and the jacking rods 18 pass through the insulation of the treatment chamber 2 and are supported outside the said chamber 2.

The billet 1 resting on rolls 14 is introduced horizontally into the treatment room 2 until it reaches a stop. The billet 1 is then moved back slightly in the reverse direction until it is in the correct horizontal position in the treatment chamber 2. Next, the jacking units are actuated causing the frame 16 and with that also the double V-rolls 22 to be pushed upwards until the longitudinal axis of billet 1, seen in FIG. 6, is coincident with the central axis of the treatment chamber 2.

The double V-shaped rolls 22 are of a refractory material and are uniformly spaced along the length of billet 1. Except for the middle double-V roll 22 all the other such rolls 22 can rotate; this ensures that the thermal expansion of the billet 1 due to the heating it experiences takes place equally from the middle towards both ends of the billet 1.

In a version of the furnace according to the invention having a plurality of treatment chambers 2 the jacking devices for the individual chambers 2 can be actuated independently of each other so that individual charging of the individual chambers 2 is possible.

For production purposes the described design of nozzle outlet provides the simplification that with the same nozzle outlet, which can be made for example by appropriate deformation using a punch or forging type tool, the desired impingement angle can be achieved i.e. as perpendicular as possible to the central axis of the cylindrical billet. This way one achieves overall uniform flow of the heating gases away from the billet 1, which in turn results in uniform heat transfer over the surface of the billet 1.

What is claimed is:

1. Furnace for heating billets, rods, tubes and the like cylindrical charges having a longitudinal axis which comprises: at least one treatment chamber having two ends and walls and a mid point, nozzle outlets in said walls which direct jets of heated gas radially with respect to said longitudinal axis and onto the surface of the charge wherein said nozzle outlets are situated in said walls so that the points of impingement of the jet streams on the mantle of the cylindrical charge are such that if the surface of the charge were to be rolled out to form a flat surface, the said points would lie at the corners of equilateral triangles wherein the length of the sides of the equilateral triangles is about the same as the distance between the nozzle outlet face and the surface of a charge of average diameter, feed channels at both ends of the treatment chamber communicating with said nozzles for supplying heated gas to the nozzles, said channels having inlets wherein the feed channels reduce in cross-section from the inlet end to the mid point, a transportation device for moving the charge in the direction parallel to its longitudinal axis into the treatment chamber including a conveyance device for the horizontal movement of the charge and a jacking device for centering the charge in the treatment chamber vertical to the longitudinal axis of the charge and as a function of its size in cross-section, a ventilator fan communicating with said chamber for generating a circulating gas stream arranged above the mid point along the length of said chamber such that it blows out the inlets to said feed channels, and a heating device for heating the gas stream.

2. Furnace according to claim 1 wherein said chamber has a shape similar to the cross-section of the charge.

3. Furnace according to claim 1 wherein the nozzle outlet is circular and the diameter on the exit side of the nozzle is about 1/5 of the average distance between the nozzle outlet and the charge surface.

4. Furnace according to claim 1 wherein a suction chamber that extends approximately the whole length of the charge is provided above the treatment chamber.

5. Furnace according to claim 1 wherein the ventilator is connected to the suction chamber and conveys the gas symmetrically to both sides in diffusers.

6. Furnace according to claim 2 wherein burners are provided at the end of the diffusers, the flames from which burners being directed towards the circulating gas flowing from the ventilator.

7. Furnace according to claim 1 wherein the transportation device for conveying the charge is formed by a horizontal set of rolls.

8. Furnace according to claim 1 wherein the jacking device features a supporting frame which can be moved vertically by jacking facilities and double V-shaped rolls to support the charge.

9. Furnace according to claim 8 wherein the double V-shaped roll at the mid-length point of the charge is fixed.

* * * * *

UNITED STATES PATENT AND TRADEMARK OFFICE

CERTIFICATE OF CORRECTION

PATENT NO. : 4,620,840

DATED : November 4, 1986

INVENTOR(S) : BERNHARD HILGE ET AL.

It is certified that error appears in the above-identified patent and that said Letters Patent is hereby corrected as shown below:

In Column 6, claim 5, line 17, change the dependency from "claim 1" to read ---claim 4---.

In Column 6, claim 6, line 20, change the dependency from "claim 2" to read ---claim 5---.

Signed and Sealed this

Seventeenth Day of February, 1987

*Attest:*

DONALD J. QUIGG

*Attesting Officer*

*Commissioner of Patents and Trademarks*